United States Patent [19]

Oka et al.

[11] Patent Number: 4,690,858

[45] Date of Patent: Sep. 1, 1987

[54] THERMAL TRANSFER SHEET

[75] Inventors: Hiroyuki Oka; Shinichi Akasaka; Shuichi Ohara; Shintaroo Hattori; Yasuki Mori, all of Hitachi; Toshikazu Narahara, Ibaraki; Hiroshi Matsumoto, Hitachi, all of Japan

[73] Assignees: Hitachi, Ltd., Tokyo; Nitto Electric Industrial Co., Ltd., Osaka, both of Japan

[21] Appl. No.: 828,974

[22] Filed: Feb. 13, 1986

[30] Foreign Application Priority Data

Feb. 15, 1985 [JP] Japan ..... 60-26311
Mar. 15, 1985 [JP] Japan ..... 60-50336

[51] Int. Cl.[4] ..... B41M 5/26

[52] U.S. Cl. ..... 428/216; 8/471; 428/195; 428/207; 428/211; 428/336; 428/337; 428/474.4; 428/474.9; 428/475.2; 428/475.5; 428/476.3; 428/479.3; 428/913; 428/914

[58] Field of Search ..... 428/195, 207, 211, 474.4, 428/913, 914, 212, 214–216, 336, 337, 473.5, 474.7, 474.9, 475.2, 475.5, 476.3, 479.3, 479.4; 8/470, 471

[56] References Cited

U.S. PATENT DOCUMENTS 4,253,838 3/1981 Mizuno et al. ..... 428/914

*Primary Examiner*—Bruce H. Hess
*Attorney, Agent, or Firm*—Antonelli, Terry & Wands

[57] ABSTRACT

A thermal transfer recording sheet comprising a substrate and ink layer formed thereon containing one or more sublimable dyes and a high-molecular-weight polyamide obtained from dimer acids as a binder is good in adherence of the ink layer to the substrate, and thermal transfer properties to give clear color hard copies.

15 Claims, No Drawings

THERMAL TRANSFER SHEET

BACKGROUND OF THE INVENTION

This invention relates to a thermal transfer recording sheet which can print various still pictures such as those picked up by a video camera and viewed on a TV screen, those used in personal computers, etc., as hard copies. More particularly, this invention relates to a thermal transfer recording sheet which can give a color copy by sublimation transfer of a sublimable dye to an image-receiving sheet.

As recording methods for giving color images, there have been used an electro-photographic method, an ink-jet method, a thermal transfer recording method, etc. The thermal transfer recording method is advantageous in that no noise is produced and maintenance of the apparatus is easy. The thermal transfer recording method is a recording method comprising using a solidified-color ink sheet and an image-receiving sheet, and forming images on the image-receiving sheet by hot-melt transfer or sublimation transfer of the ink with thermal energy controlled by electric signals using laser, a thermal head, or the like. In the thermal transfer method, there are a hot-melt transfer method and a sublimation transfer method using sublimable dyes. According to the hot-melt transfer method, an ink paper obtained by bonding a pigment or dye with thermally molten wax is used, and the pigment or dye together with wax melted by thermal energy of a thermal head is transferred to an image-receiving sheet. Therefore, there are defects in that it is difficult to obtain a half-tone necessary as image quality, and a good hue cannot be obtained due to the transferred wax.

On the other hand, the sublimation transfer method, using sublimable dyes applies a conventional sublimation transfer textile printing technique, uses a transfer sheet obtained by, in general, binding a relatively sublimable disperse dye as the sublimable dye with a binder, and obtains a color image by subliming the sublimable dye with heat energy of a thermal head and transferring it to an image-receiving sheet. Since the sublimable dye sublimes corresponding to the heat energy of the thermal head, this method has an advantage in that the half-tone is easily obtained. An important thing in the sublimation transfer method is the ink composition. Further, the most important thing which must be taken care of in the preparation of the ink composition is the selection of a proper binder. It is undesirable that a binder is molten or increases its viscosity remarkably by the heat at the time of transfer, and in such a case, the binder resin is also transferred to an image-receiving sheet to which the ink is transferred. As the binder, the use of nylon type polyamides is disclosed in, e.g., JP-A (Kokai) Nos. 59-14994 and 59-71898. Nylon can give a very tough film but is disadvantageous in that it has a high water absorption rate and is hardly dissolved in a solvent, etc. Further, in order to effectively use the heat energy of the thermal head, a thin polymer film of 6 μm or less in thickness is used as a substrate in place of condenser paper, tissue paper, or a polymer film of 8 μm in thickness. In such a case, the adherence of the film and the ink layer becomes a problem. Nylon is not so good in adherence. That is, when the adherence to the film is not good, the ink layer per se is transferred to the image-receiving sheet by the heat of thermal head, resulting in causing an undesirable, abnormal transfer phenomenon.

SUMMARY OF THE INVENTION

It is an object of this invention to provide a thermal transfer recording sheet having an ink layer comprising a sublimable dye and a binder and having good adherence to a substrate without causing abnormal transfer.

This invention provides a thermal transfer recording sheet comprising a substrate and an ink layer formed thereon containing one or more sublimable dyes and a binder, said binder being a high molecular weight polyamide resin obtained from dimer acids.

DESCRIPTION OF THE PREFERRED EMBODIMENTS

The thermal transfer recording sheet of this invention is good in adhesive properties, low in water absorption rate, and meets the requirements sufficiently without causing abnormal transfer.

As the substrate, there can be used cellulose series paper such as condenser paper, glassine paper, tissue paper, cellophane, parchment paper, etc.; and polymer films having relatively good heat resistance and made from polyesters, polycarbonates, triacetyl cellulose, nylons, polyimides, etc.

The thickness of the substrate is not limited, but it is preferable that the substrate be as thin as possible in order to make thermal conductivity of the thermal head effective. For example, in the case of polymer films, e.g. polyethylene terephthalate (PET) film, the thickness is preferably 6 μm or less. In such a case, in order to make the running properties of thermal head smooth, it is preferable to form a smooth heat resistant layer on the side of the substrate contacting the thermal head.

The smooth heat resistant layer can be formed by using a silicone resin, an epoxy resin, a melamine resin, a phenol resin, a fluorine series resin, a polyimide resin, nitrocellulose, etc. In forming the smooth heat resistant layer, a surface active agent or an organic salt may be added to a resin used. It is also possible to use an inorganic pigment having higher smoothness and a thermosetting resin having a higher softening point. For example, a composition comprising a 50% xylene solution of silicone varnish and a curing agent such as a metal salt of organic acid in an amount of 2 to 20% by weight based on the weight of the silicone resin is coated on a substrate and cured with heating to give the smooth heat resistant layer.

The ink layer comprising one or more sublimable dyes and a binder is formed on the substrate.

As the sublimable dyes, there can be used conventional sublimable dyes and disperse dyes which can vaporize from solids or liquids at a temperature of about 100° to 200° C. under an atmospheric pressure, have a molecular weight of about 200 to 400, and can be adsorbed in synthetic resin materials such as nylons, polyesters, acetate resins, etc. Examples of such dyes are conventional ones belonging to anthraquinone series, azo series, styryl series, quinophthalone series, nitrodiphenylamine series, etc.

As the binder, it is necessary to use high-molecular-weight polyamide resins obtained from dimer acids. The dimer acids are obtained by a Diels-Alder addition reaction of vegetable-oil acids such as linoleic acid, etc. Besides the true dimer, the dimer acids include dibasic dimeric fatty acids, the monomeric fatty acids, the trimers, and the higher polymers that are always present in the thermal and catalytic polymerization products of unsaturated vegetable-oil acids or esters. The high-molecular-weight polyamides can be obtained by a conventional method from the dimer acids and amines such as di- or polyamines. The molecular weight of the polyamides is sufficient when it is about 4000 or higher, and is more preferable when it is 6,000 to 40,000 or more. Such polyamides are known as fatty polyamides and are commercially available under the trade names of Versamid series (mfd. by Henkel-Hakusui Co.) (mol. wt. upto about 8,000), Versalon series (mfd. by Henkel-Hakusui Co.) (mol. wt. about 6,000 to 20,000), Milvex series (mfd. by Henkel-Hakusui Co.) (mol. wt. about 30,000 to 40,000), etc.

These polyamides are particularly good in adherence to the substrate such as polymer films, e.g. PET film.

A more important property of the polyamides than the molecular weight is the softening point. Preferable softening point is 100° C. or higher, more preferably 100° C. to 220° C. When the softening point is lower than 100° C., there is a tendency to melt the polyamide or make it remarkably viscous to transpart the resin to the image-receiving sheet, resulting in worsening the image quality. On the other hand, even when the softening point becomes higher than 220° C., such a polyamine can be used after filtration without lowering the properties.

Such polyamides are very low in water absorption rate, mostly 2% or less. This property is very preferable as the binder for thermal transfer sheet which binder is required to have the water absorption rate as low as possible.

The sublimable dyes and the binder are dissolved in an organic solvent and coated on the substrate to form the ink layer on the substrate. As the organic solvent, there can be used alcohols, esters, ketones, conventionally used; a mixed solvent of an aliphatic or aromatic hydrocarbon such as toluene, xylene, etc., and an alcohol such as isopropyl alcohol, etc. (the mixing ratio of 1/4 to 4/1 by weight usually); and halogenated hydrocarbons such as chloroform, etc. In the case of polyamides having particularly high molecular weights, the use of the mixed solvent is preferable.

The ink composition used for forming the ink layer may further contain conventional additives such as one or more fillers, dispersion aids, etc.

The ink composition preferably comprises 1 to 20% by weight of the dye, 2 to 40% by weight of the binder, and 40 to 97% by weight of the solvent.

The ink composition is coated on the substrate by a conventional method by using, for example, a blade coater, a gravure coater, a roll coater, a curtain coater, a bar coater, an air knife coater, or the like in the thickness of 5 μm or less. The coated ink layer is dried with heating to give the desired thermal transfer recording sheet.

The resulting thermal transfer recording sheet is piled on an image-receiving sheet, and given heat energy by a thermal head to sublime the sublimable dye and to finally form the image on the image-receiving sheet. According to this invention, the binder in the ink layer is not softened excessively nor does it become viscous by heating of the thermal head, and a clear image can be obtained without transferring the binder to the image-receiving sheet. Further, when a mixed solvent of an alcohol and an aromatic hydrocarbon is used as the solvent, no fusing of the binder in the ink layer takes place during natural drying immediately after the coating. Moreover, drying can be conducted in a very short time even at room temperature, and when heated at about 50° C., the drying can be completed in several seconds. In addition, since no vaporization of the sublimable dye is admitted during the drying, the production of the thermal transfer recording sheet can be carried out without causing air pollution.

This invention is illustrated by way of the following Examples, in which all parts and percents are by weight unless otherwise specified.

EXAMPLE 1

| | |
|---|---|
| Kayaset Yellow G (mfd. by Nippon Kayaku Co., Ltd.) | 10 parts |
| Versalon-1138 (softening point 135–145° C.: mfd. by Henkel-Hakusui Co.) | 45 parts |
| Isopropyl alcohol/toluene (3/1 by wt.) | 20 parts |
| Hexane | 25 parts |

The above-mentioned ingredients were ball milled for 48 hours to given an ink composition in dispersed state containing the sublimable dye. The ink composition was coated on a front side of polyester film (PET: 6 μm thick) having a smooth heat resistant layer on a back side, followed by drying at 80° C. for 3 seconds to give a thermal transfer recording sheet of this invention. The thickness of the ink layer was 0.8 μm.

Then, thermal transfer properties of the resulting thermal transfer recording sheet were tested as follows. As an image-receiving sheet, coat paper or synthetic paper coated with a polyester was used. The thermal transfer recording sheet and the image-receiving sheet were piled, and gradation was examined by changing pulse duration under thermal head recording conditions of 6 dots/mm in major and sub scanning, and 0.3 to 0.4 W/dot in applied electric power. The hue was good and the gradation was also good. The melting of the ink layer due to the heat and transfer of the binder to the image-receiving sheet, that is, abnormal transfer were not admitted. The coloring saturated density measured by a reflector type densitometer DM-400 (mfd. by Dainippon Screen Co., Ltd.) was 0.9.

EXAMPLE 2

| | |
|---|---|
| Kayaset Red G (mfd. by Nippon Kayaku Co., Ltd.) | 16.4 parts |
| Versalon-1117 (softening point 112–123° C.: mfd. by Henkel-Hakusui Co.) | 10 parts |
| Isopropyl alcohol/toluene (3/1 by wt.) | 30 parts |
| Hexane | 43.6 parts |

Using the above-mentioned ingredients, a thermal transfer recording sheet was obtained in the same manner as described in Example 1. The thickness of the ink layer was 1 μm. Good gradation was obtained without causing the melting of binder and abnormal transfer. The coloring saturated density was 1.7.

EXAMPLE 3

| | |
|---|---|
| Kayaset Blue 136 (mfd. by Nippon Kayaku Co., Ltd.) | 10 parts |
| Versalon-1117 | 48 parts |

-continued

| | |
|---|---|
| Isopropyl alcohol/toluene (3/1 by wt.) | 18 parts |
| Hexane | 24 parts |

EXAMPLE 4

| | |
|---|---|
| Lurafix Blue 660 (mfd. by BASF AG) | 13.4 parts |
| Versalon-1124 (softening point 122–132° C.: mfd. by Henkel-Hakusui Co.) | 8.0 parts |
| Isopropyl alcohol/toluene (3/1 by wt.) | 32.1 parts |
| Hexane | 46.5 parts |

EXAMPLE 5

| | |
|---|---|
| Lurafix Red 430 (mfd. by BASF AG) | 10 parts |
| Versalon-1138 (softening point 135–145° C.: mfd. by Henkel-Hakusui Co.) | 20 parts |
| Isopropyl alcohol/toluene (3/1 by wt.) | 70 parts |

EXAMPLE 6

| | |
|---|---|
| Lurafix Yellow 142 (mfd. by BASF AG) | 9.4 parts |
| Versalon-1139 (softening point 135–145°: mfd. by Henkel-Hakusui Co.) | 45 parts |
| Isopropyl alcohol/toluene (3/1 by wt.) | 20 parts |
| Hexane | 25.6 parts |

Using the ingredients shown in Examples 3 to 6, thermal transfer recording sheets of this invention were obtained in the same manner as described in Example 1. The test results are shown in Table 1.

COMPARATIVE EXAMPLE 1

| | |
|---|---|
| Lurafix Blue 660 | 10 parts |
| Versalon-1300 (softening point 95–100° C.: mfd. by Henkel-Hakusui Co.) | 20 parts |
| Isopropyl alcohol/toluene (3/1 by wt.) | 25 parts |
| Hexane | 35 parts |

Using the above-mentioned ingredients wherein the Versalon having a softening point of 95°–100° C. is outside of this invention, a thermal transfer recording sheet was obtained in the same manner as described in Example 1. The test results are shown in Table 1.

TABLE 1

| Example No. | Saturated density (D) | Melting of binder | Abnormal transfer | Gradation | Adherence to substrate |
|---|---|---|---|---|---|
| Example 1 | 0.9 | None | None | Good | Good |
| Example 2 | 1.7 | " | " | " | " |
| Example 3 | 1.7 | " | " | " | " |
| Example 4 | 1.8 | " | " | " | " |
| Example 5 | 1.8 | " | " | " | " |
| Example 6 | 0.8 | " | " | " | " |
| Comparative Example 1 | 2.2 | Yes | Yes | " | " |

EXAMPLE 7

| | |
|---|---|
| Kayaset Yellow G | 10 parts |
| Versamid-725 (softening point 125°–135° C.: mfd. by Henkel-Hakusui Co.) | 45 parts |
| Isopropyl alcohol/toluene (3/1 by wt.) | 20 parts |
| Hexane | 25 parts |

EXAMPLE 8

| | |
|---|---|
| Kayaset Red G | 16.4 parts |
| Versamid-865 (softening point 168–184° C.: mfd. by Henkel-Hakusui Co.) | 10 parts |
| Isopropyl alcohol/toluene (3/1 by wt.) | 30 parts |
| Hexane | 43.6 parts |

EXAMPLE 9

| | |
|---|---|
| Kayaset Blue 136 | 10 parts |
| Versamid-725 | 48 parts |
| Isopropyl alcohol/toluene (3/1 by wt.) | 18 parts |
| Hexane | 24 parts |

EXAMPLE 10

| | |
|---|---|
| Lurafix Blue 660 | 13.4 parts |
| Versamid-711 (softening point 105–110° C.: mfd. by Henkel-Hakusui Co.) | 8.0 parts |
| Isopropyl alcohol/toluene (3/1 by wt.) | 32.1 parts |
| Hexane | 46.5 parts |

EXAMPLE 11

| | |
|---|---|
| Lurafix Red 430 | 10 parts |
| Versamid-930 S (softening point 105–110° C.: mfd. by Henkel-Hakusui Co.) | 20 parts |
| Isopropyl alcohol/toluene (3/1 by wt.) | 30 parts |
| Hexane | 40 parts |

COMPARATIVE EXAMPLE 2

| | |
|---|---|
| Lurafix Red 430 | 10 parts |
| Versamid-871 (softening point 80–100° C.: mfd. by Henkel-Hakusui Co.) | 20 parts |
| Isopropyl alcohol/toluene (3/1 by wt.) | 30 parts |
| Hexane | 40 parts |

Using the ingredients shown in Examples 7 to 11 and Comparative Example 2, thermal transfer recording sheets were obtained in the same manner as described in Example 1. The test results are shown in Table 2.

TABLE 2

| Example No. | Saturated density (D) | Melting of binder | Abnormal transfer | Gradation | Adherence to substrate |
|---|---|---|---|---|---|
| Example 7 | 0.9 | None | None | Good | Good |
| Example 8 | 1.7 | " | " | " | " |
| Example 9 | 1.8 | " | " | " | " |
| Example 10 | 1.7 | " | " | " | " |
| Example 11 | 1.8 | " | " | " | " |
| Comparative Example 2 | 2.0 | Yes | Yes | Slightly good | " |

EXAMPLE 12

| | |
|---|---|
| Lurafix Blue 660 | 16.4 parts |
| Milvex-1000 (softening point 130–150° C.: mfd. by Henkel-Hakusui Co.) | 10 parts |
| Isopropyl alcohol/toluene (3/1 by wt.) | 30 parts |
| Hexane | 43.6 parts |

EXAMPLE 13

| | |
|---|---|
| Lurafix Red 430 | 10 parts |
| Milvex-1235 (softening point 195–220° C.: mfd. by Henkel-Hakusui Co.) | 20 parts |
| Isopropyl alcohol/toluene (3/1 by wt.) | 30 parts |
| Hexane | 40 parts |

Using the ingredients shown in Examples 12 and 13, thermal transfer recording sheets were obtained in the same manner as described in Example 1. The test results are shown in Table 3.

TABLE 3

| Example No. | Saturated density (D) | Melting of binder | Abnormal transfer | Gradation | Adherence to substrate |
|---|---|---|---|---|---|
| Example 12 | 1.7 | None | None | Good | Good |
| Example 13 | 1.7 | " | " | " | " |

Needless to say, by using the thermal transfer recording sheet of this invention, full-color recording can be conducted by selecting proper coloring materials of cyan, yellow and magenta type colors, respectively, which are three primary colors.

As mentioned above, according to this invention, the high-molecular-weight polyamide obtained from dimer acids is well dissolved in a solvent, and excellent in adherence to the substrate such as polymer films, so that it fully satisfies properties required for the color thermal transfer recording sheet. Therefore, no abnormal transfer and no melting due to the heat of thermal head take place. Further, it is generally said that sharp images are difficult to obtain by the dispersing type, but according to this invention, since the dispersibility is improved, sharp images can be obtained.

What is claimed is:

1. A thermal transfer recording sheet comprising a substrate and an ink layer formed thereon containing one or more sublimable dyes and a binder, said binder being a high-molecular-weight polyamide obtained from dimer acids and having a softening point of 100° C. or higher.

2. A thermal transfer recording sheet according to claim 1, wherein the polyamide has a softening point of 100° C. to 220° C.

3. A thermal transfer recording sheet according to claim 1, wherein the polyamide has a molecular weight of 4000 or more.

4. A thermal transfer recording sheet according to claim 1, wherein the polyamide has a molecular weight of 6000 to 20,000.

5. A thermal transfer recording sheet according to claim 1, wherein the polyamide has a molecular weight of 30,000 to 40,000.

6. A thermal transfer recording sheet according to claim 1, wherein the substrate is cellulose series paper or a polymer film.

7. A thermal transfer recording sheet according to claim 1, wherein the ink layer is obtained by coating on the substrate an ink composition comprising 1 to 20% by weight of a sublimable dye, 2 to 40% by weight of a high-molecular-weight polyamide obtained from dimer acids, and 40 to 97% by weight of an organic solvent.

8. A thermal transfer recording sheet according to claim 7, wherein said sublimable dye is capable of vaporizing at a temperature about 100° to 200° C. under atmospheric pressure.

9. A thermal transfer recording sheet according to claim 8, wherein said sublimable dye has a molecular weight of about 200 to 400.

10. A thermal transfer recording sheet according to claim 7, wherein said organic solvent comprises a material selected from the group consisting of alcohols, esters, ketones and halogenated hydrocarbons.

11. A thermal transfer recording sheet according to claim 7, wherein said organic solvent comprises a mixed solvent of an aliphatic or aromatic hydrocarbon and an alcohol.

12. A thermal transfer recording sheet according to claim 11, wherein said organic solvent comprises a mixture of toluene and isopropyl alcohol.

13. A thermal transfer recording sheet according to claim 7, wherein said ink composition consists essentially of said sublimable dye, said high-molecular-weight polyamide obtained from dimer acids and said organic solvent.

14. A thermal transfer recording sheet according to claim 1, wherein the substrate is a polymer film.

15. A thermal transfer recording sheet according to claim 14, wherein said substrate has a thickness of 6 μm or less.

16. A thermal transfer recording sheet according to claim 15, wherein said ink layer has a thickness of 5 μm or less.

* * * * *